US006477974B2

(12) United States Patent
Hobdy

(10) Patent No.: US 6,477,974 B2
(45) Date of Patent: Nov. 12, 2002

(54) RADIAL BEARING ARRANGEMENT AND METHOD FOR INSTALLATION

(75) Inventor: Miles A. Hobdy, Houston, TX (US)

(73) Assignee: FMC Technologies, Inc., DE (US)

( * ) Notice: Subject to any disclaimer, the term of this patent is extended or adjusted under 35 U.S.C. 154(b) by 0 days.

(21) Appl. No.: 10/093,126

(22) Filed: Mar. 6, 2002

(65) Prior Publication Data

US 2002/0124788 A1 Sep. 12, 2002

Related U.S. Application Data

(60) Provisional application No. 60/273,655, filed on Mar. 6, 2001.

(51) Int. Cl.[7] ..... B63B 21/00

(52) U.S. Cl. ..... 114/230.12; 114/230.1

(58) Field of Search ..... 114/230.1, 230.12, 114/293; 441/3–5; 384/114–120, 192, 193, 275, 282, 283, 284; 166/354

(56) References Cited

U.S. PATENT DOCUMENTS 3,440,671 A * 4/1969 Smulders ..... 441/5
3,602,302 A * 8/1971 Kluth ..... 166/336
3,735,435 A * 5/1973 Mikulicic et al. ..... 441/5
4,305,341 A * 12/1981 Stafford ..... 114/230
4,955,310 A 9/1990 Pollack
5,316,509 A * 5/1994 Boatman et al. ..... 441/3
5,515,804 A 5/1996 Pollack
5,782,197 A * 7/1998 Pollack ..... 114/230.12
5,860,382 A * 1/1999 Hobdy ..... 114/230.12
6,263,822 B1 * 7/2001 Fontenot et al. ..... 114/230.12

* cited by examiner

*Primary Examiner*—S. Joseph Morano
*Assistant Examiner*—Ajay Vasudeva
(74) *Attorney, Agent, or Firm*—Gary L. Bush; Andrews & Kurth, LLP

(57) ABSTRACT

A lower bearing arrangement between a turret of an FPU and a moonpool. The outer housing of the bearing is mounted about the turret instead of the FPU's hull structure. Bearing segments are captured between an outer ring of the turret and an inner ring of the outer housing. The outer housing of the bearing assembly is coupled to a reaction ring of the moonpool so that rotation forces of the vessel are transferred to the outer housing of the bearing. The coupling also includes an arrangement by which the outer housing contacts said reaction ring in the nature of a spherical joint.

19 Claims, 3 Drawing Sheets

RADIAL BEARING ARRANGEMENT AND METHOD FOR INSTALLATION

CROSS REFERENCE TO RELATED APPLICATION

This application claims priority from Provisional Application 60/273,655 filed Mar. 6, 2001.

BACKGROUND OF THE INVENTION

1. Field of the Invention

This invention relates generally to turret moored Floating Production Units (FPUs) and in particular to lower bearing arrangements which provide radial sliding support by which a vessel can weathervane, that is rotate, about the turret.

2. Description of the Prior Art

U.S. Pat. No. 4,955,310 provides a lower radial bearing arrangement between a turret and an opening of a lower support arm which is secured by the vessel. The lower bearing arrangement permits the lower part of the turret to pivot about a pair of horizontal axes. An upper bearing arrangement is also provided such that the upper bearing can pivot about a pair of horizontal axes. The turret is free to move axially (at least to a small extent) through the lower bearing arrangement at the interface between the turret and the bearing pads. The outer housing for the lower bearing is rigidly attached to the vessel.

U.S. Pat. No. 5,515,804 discloses a resiliently mounted upper bearing arrangement which is an improvement of the '310 patent mentioned above. Lower bearing segments are illustrated which allow the lower bearing to tilt about a horizontal axis to allow it to follow the turret when the turret wobbles during turning due to misalignment.

U.S. Pat. No. 5,316,509 discloses a lower bearing assembly. Bushing segments are carried by a bushing block which is rollingly supported from a support block fixed to a structural support of the lower turret. The bushing must be radially adjusted when the turret is inserted within the lower bearing assembly. In other words, the turret is inserted into the bearing upon installation.

U.S. Pat. No. 5,782,197 discloses a lower bearing arrangement between a moonpool of a vessel and the lower portion of a turret. A plurality of segment structures are provided where each segment includes a base and an elastic body that supports the bearing segment while allowing it to move radially or tilt.

A disadvantage of the bearing arrangements of the prior art patents '310, '804 and '509 identified above is that the lower bearing outer housings are rigidly secured to the vessel's structure (i.e., moonpool) with elastomer material provided between the outer housing and the bearing surface. Because the turret is arranged to move axially within the lower bearing arrangement and to react against frictional loads, such designs are arranged to limit shear forces on the elastomer materials.

All of the lower bearing designs described above call for the bearing assembly to be secured to the bottom of the moonpool prior to the installation of the turret into the moonpool and within the outer housing of the lower bearing assembly. Adjustment of the bearing segments must then be made at a place which is difficult to reach by workmen and at a time in the installation process which is costly.

3. Identification of Objects of the Invention

A primary object of this invention is to provide a new lower bearing assembly for a turret moored Floating Production Unit (FPU) vessel that is mounted to the turret instead of to the vessel's hull structure while allowing the outer housing of the bearing to "ride" or move with the turret while the turret undergoes wobble (that is, small tilting) motion due to structural deflections and other influences at the top of the turret.

Another object of the invention is to provide a coupling between an outer housing of the lower radial bearing of the turret that is coupled to a reaction ring of the moonpool so that rotational force of the vessel is transferred to the outer housing such that radial bearing support is provided between the turret and the moonpool.

Another object of the invention is to provide a coupling between an outer housing of the lower radial bearing of the turret which includes a curved profile of an outer surface which contacts an inner surface of a reaction ring on the moonpool such that contact occurs between the outer and inner surfaces when the turret wobbles or tilts with respect to the vessel.

Another object of the invention is to provide an outer housing of a bearing structure which is arranged and designed to fit about an exterior ring around the turret and to allow for the installation and capturing of segmented bushings between the turret ring and the outer housing such that the bearing assembly can be mounted on the turret before installation of the turret in the moonpool of the vessel.

Another object of the invention is to provide an outer housing of a lower bearing assembly that is secured to the turret and has an outer rim with an outer facing curved profile arranged and designed to slide and/or roll with respect to a cylindrical surface of a reaction ring in the moonpool of the vessel thereby emulating a spherical joint.

SUMMARY OF THE INVENTION

The objects identified above along with other features and advantages are provided with a lower bearing arrangement that is fixed axially to the turret shaft. The lower part of the turret may "wobble" or pivot about the center line of the moonpool. Because the lower bearing assembly is fixed to the bottom of the turret, it "rides" on a reaction ring installed in the moonpool when there is turret wobble.

The lower bearing assembly of the invention includes an outer housing which is mounted on an inner ring of a cylindrical section which can be welded in the lower portion of the turret. The inner ring alternatively can be secured about the end of the lower turret. A segmented bushing is secured about the inner periphery of the outer housing such that the bushing of the outer housing has rotating sliding contact with the inner ring surface of the turret. The outer housing is mounted with respect to the turret such that it is free to rotate about the lower turret, but it is not free to move axially with respect to the turret.

The outer housing has an outer rim with a curved profile. A reaction ring, having a surface which faces the curved surface of the rim, is rigidly attached to the inside of the cavity of the moonpool. The rim of the outer housing is free to slide and/or roll a small amount on the reaction ring when the turret wobbles or pivots with respect to the vertical axis of the moonpool. The reaction ring is keyed to the outer housing so that the rotation of the moonpool (when the vessel weathervanes) is transferred to the outer housing.

BRIEF DESCRIPTION OF THE DRAWINGS

The invention is described below by reference to the drawings of which.

DESCRIPTION OF THE INVENTION

Figure 1:
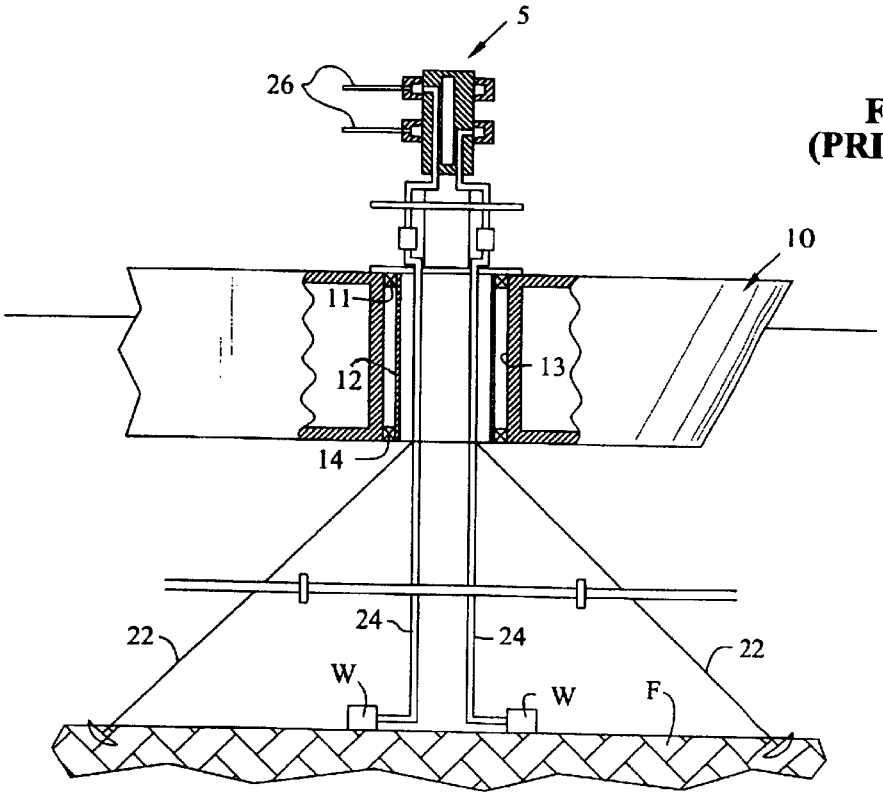
FIG. 1 (PRIOR ART)
FIG. 1 is an illustration of a prior art internal turret mooring arrangement of a vessel with upper and lower bearing assemblies where the lower bearing assembly is shown schematically for providing radial bearing support to the turret.

FIG. 1 is an illustration of a prior art arrangement for mooring a FPU such as a FPSO or FSO vessel 10 having a moonpool 13 and an internal turret 12 which is rotationally supported on vessel 10 by an upper axial/radial bearing assembly 11 and by lower radial bearing assembly 14. The turret is moored by anchor legs 22. Wells W are fluidly connected via risers 24 and pipes through the turret 12 to a product swivel 5 and pipes 26, and ultimately to storage holds (not shown) in the vessel.

Figure 2:
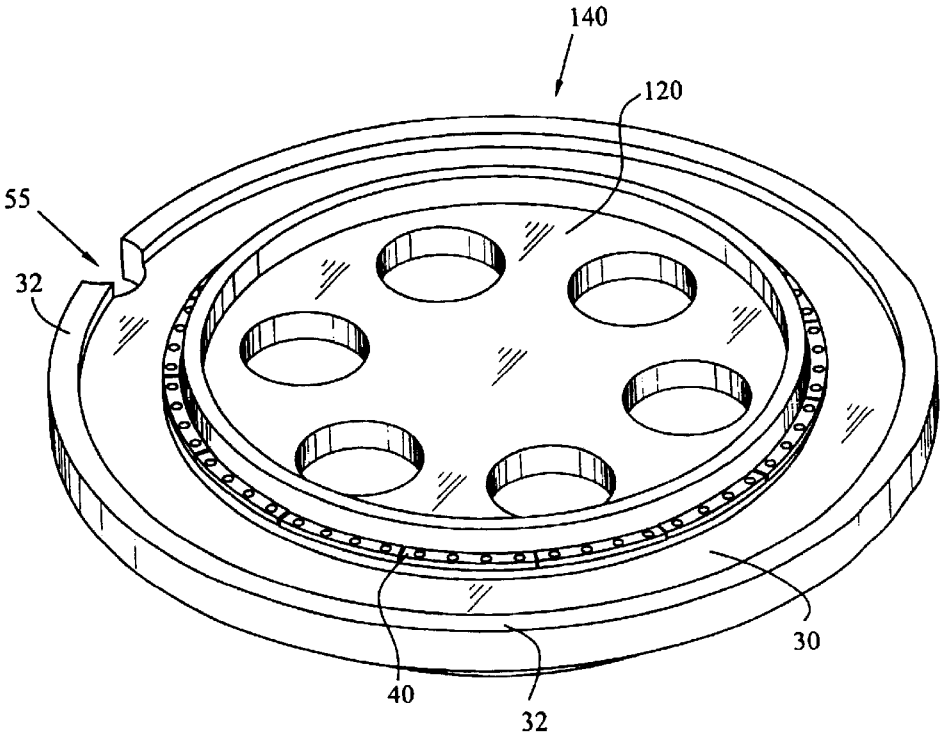
FIG. 2 is a perspective view of a segment of a lower turret with the lower bearing assembly according to the invention attached thereto.
Figure 3:
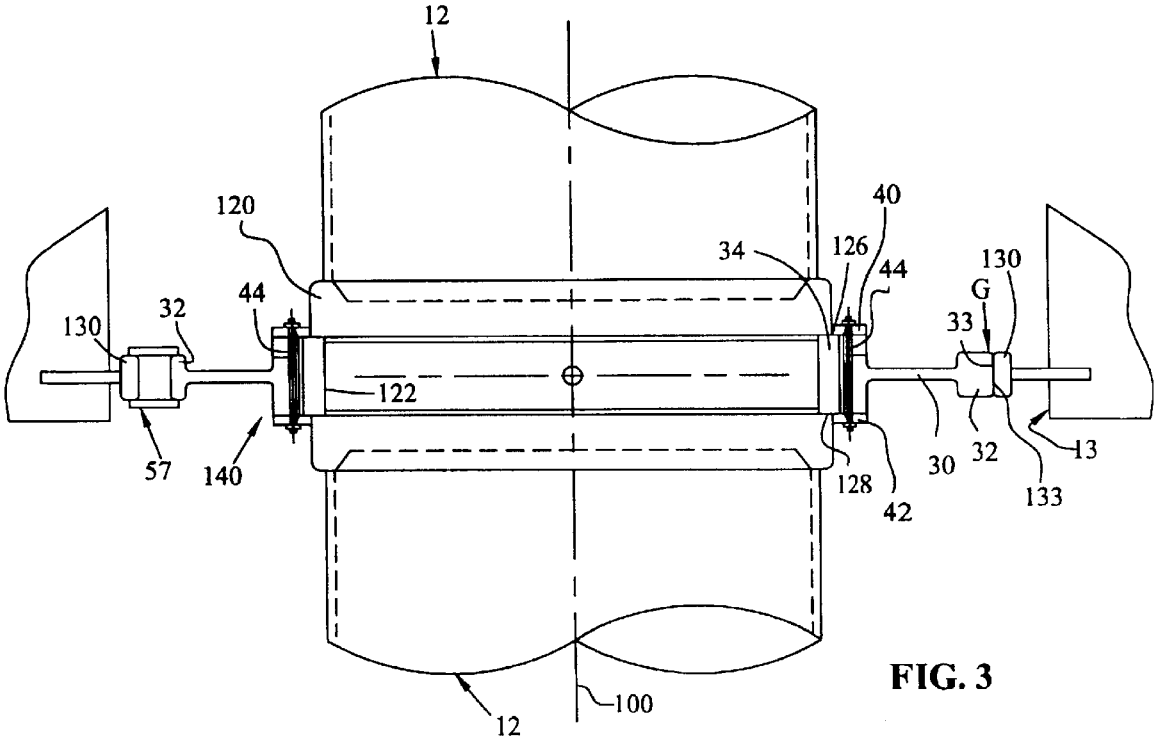
FIG. 3 is a side view illustrating a lower turret segment in a moonpool, where the turret segment is radially supported there by a lower bearing assembly according to the invention which includes an outer housing and a segmented bushing ring which provides for rotational sliding of the outer housing about an inner ring on the periphery of the turret segment with coupling of the outer housing to the moonpool hull structure by a reaction ring.
Figure 5:
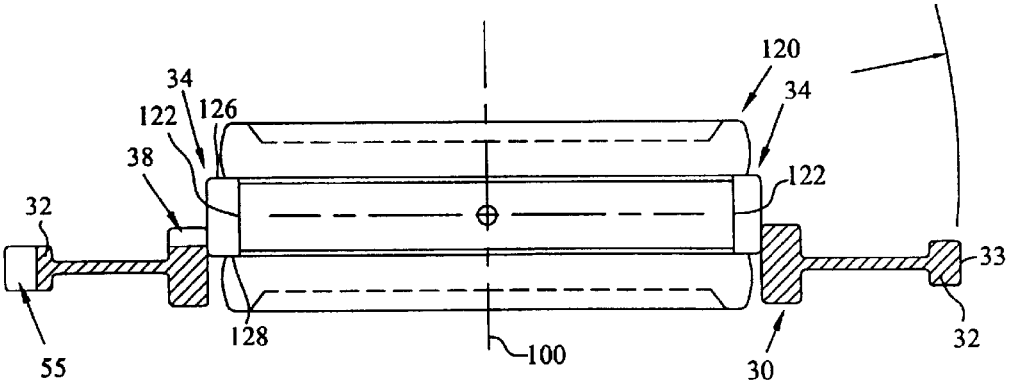
FIG. 5 is a sectional view of the turret segment with a segmented bushing installed for sliding contact about a ring on the turret segment.
Figure 4:
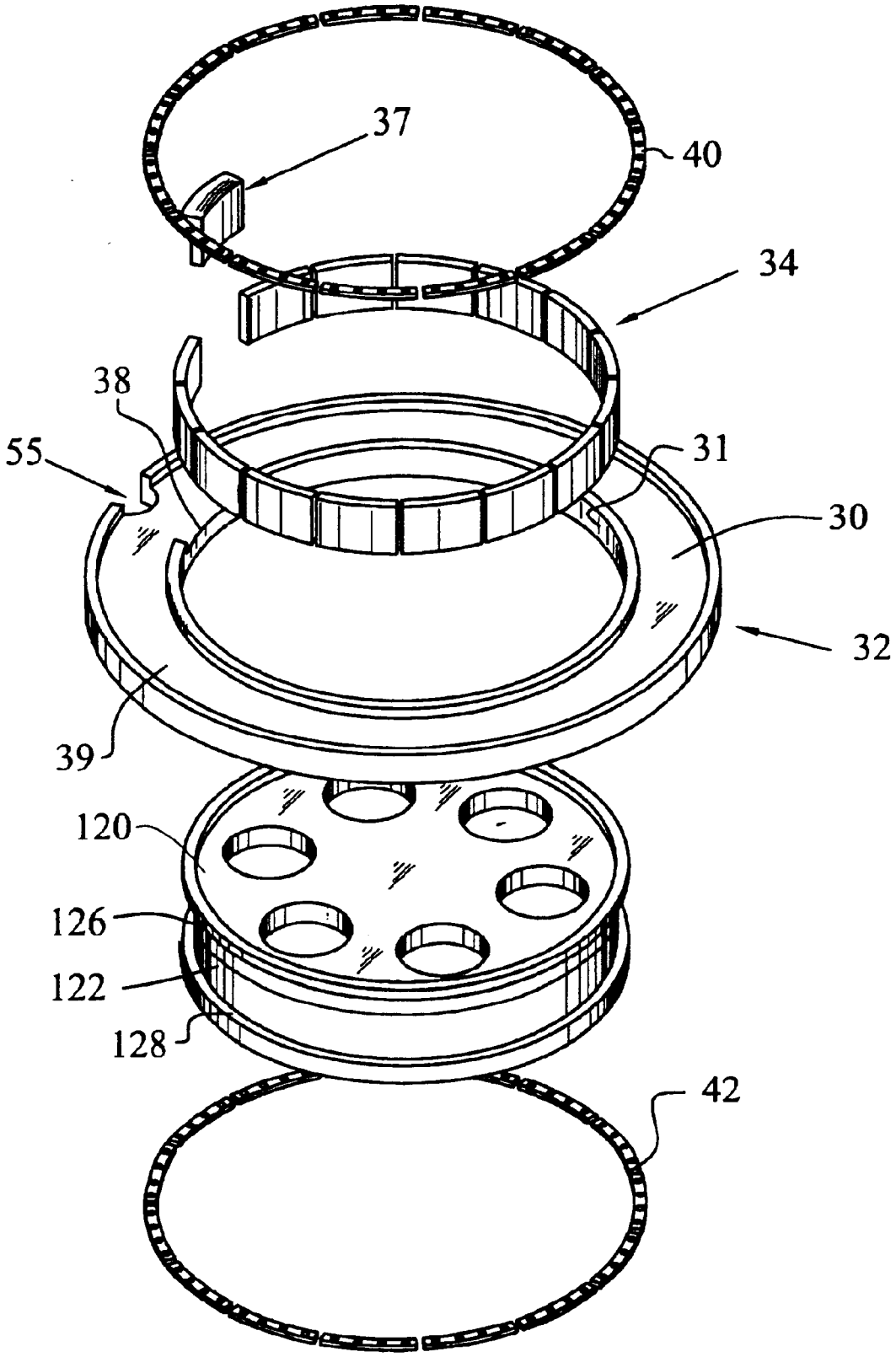
FIG. 4 is an exploded view showing how the lower bearing structure parts of the invention are assembled and secured to the turret segment.

FIGS. 2–5 illustrate a lower bearing assembly 140 embodiment of the invention. An outer housing 30 having a radially outwardly extending rim 32 is placed about the outer ring surface 122 of a lower turret segment 120. As shown in FIG. 4, the outer ring surface 122 of the turret segment 120 is provided for sliding contact with a segmented bushing 34 which is retained axially between upper and lower shoulders 126, 128 of the turret segment 120 as illustrated in FIGS. 4 and 5. As shown in FIG. 3, top and bottom retainer plates 40, 42 and threaded bolts 44 secure the segmented bushing 34 to the outer housing 30. Alternatively, the outer housing 30 can be arranged to have a lower shoulder which is adjacent shoulder 128 so that a separate bottom retainer plate can be eliminated. Thus, the outer housing 30 and the bushing 34 are free to rotate with respect to the ring surface 122 of the turret segment 120.

The outer housing 30 has an external rim 32 which has a curved outer profile 33 for contacting a reaction ring 130 which is fixed to the moonpool structure 13 as illustrated in FIG. 3. The curved outer surface 33 of the rim is arranged and designed to avoid edge loading or point contact with the outer surface 133 of the reaction ring 130. The curved surface 33 of the rim 32 and the flat (cylindrical) surface 133 of the reaction ring 130 act together as a spherical joint so that the lower bearing assembly 140 "rides" with the lower turret section 120 and the turret structure 12 during small wobble or tilting movements of the turret structure 12 center line 100 of turret 12, from that of the moonpool 13.

A radial annular space or "gap" G (see FIG. 3) exists between the outer surface 33 of the outer housing rim 32 and the inner surface 133 of the reaction ring 130. This gap G is sized to allow for pivoting of the turret 12 and ovalization of the reaction ring 130 caused by vessel 10 structural deflections, and to prohibit the reaction ring 130 from pinching the outer housing 30, and in turn, the turret 12.

The surfaces 33, 133 between the rim 32 and the reaction ring 130 are preferably of low friction bearing material, because the surface 33 primarily slides on surface 133 during turret wobble. Under certain circumstances, there may be rolling contact between surfaces 33 and 133.

The outer housing 30 is keyed to the vessel's structure as illustrated in FIG. 3 so that the vessel 10 and outer housing 30 rotate together about the turret's vertical axis. As shown in FIG. 2, a key slot 55 is provided in rim 32. As shown in FIG. 3, a key 57 in key slot 55 of housing 30 rotationally couples reaction ring 130 to outer housing 30.

As illustrated in FIG. 4, an opening 38 in an upper annular ring 39 allows segmented bushing parts 34 to be installed, moved around shoulders 126, 128 of segment 120 and the inside surface 31 of the outer housing 30, and captured between the inner housing 12 and the outer housing 30. The retainer key bushing segment 37 retains the bushing segments 34 in place by means of bolts 44. The upper and lower retainer plates 40, 42 secure the bushing and outer housing together with mounting of the outer housing 30 about the exterior of the turret segment 120 with the housing 30 and bushing 34 being capable of rotation about ring 122.

The arrangement described above allows a precision tolerance bearing assembly 140 to be connected about the exterior of the lower turret 120 before the turret 12 is installed into the moonpool 13. Bearing adjustments are performed before the turret is installed into the ship. No additional adjustments are needed. This arrangement, and the method of installation is advantageous both economically and mechanically. Economies are realized because the bearing assembly 140 can be fabricated and installed at a manufacturing facility rather than after the turret 12 is installed in the moonpool 13 of the vessel 10. The arrangement and method is mechanically advantageous in that the bearing assembly 140 "rides" with the turret 12 and achieves rotational radial support of a turret 12 within a moonpool 13 of a vessel 10 in a far less complex way than many prior designs.

Although the invention is intended primarily with internal turrets, the invention can be used for other applications such as with an externally mounted turret from upper and lower support structures.

What is claimed is:

1. A radial bearing arrangement for rotatably supporting a turret within a moonpool of a vessel, said turret having a generally vertical turret axis, the arrangement comprising, a turret support ring secured to said moonpool, said turret support ring having a ring axis, an outward facing ring surface disposed on said turret, a bearing assembly mounted on said turret including a housing having an inward facing continuous cylindrical surface and a bushing retained between said outward facing ring surface of said turret and said inward facing cylindrical surface of said housing, by which said turret is free to rotate about said turret axis with respect to said housing, and a coupling arrangement including a continuous outer facing surface of said housing and a continuous inner facing surface of said turret support riser and a gap between said outer facing surface of said housing and said inner facing surface of said turret support ring between said housing and said turret support ring, whereby said housing is prevented from rotating about said turret axis with respect to said moonpool while enabling tilting of said turret axis with respect to said ring axis.

2. A radial bearing arrangement for rotatably supporting a turret within a moonpool of a vessel, said turret having a generally vertical turret axis, the arrangement comprising, a turret support ring secured to said moonpool, said turret support ring having a ring axis, an outward facing ring surface disposed on said turret, a bearing assembly mounted on said turret including a housing having an inward facing cylindrical surface and a bushing retained between said outward facing ring surface of said turret and said inward facing cylindrical surface of said housing, by which said turret is free to rotate about said turret axis with respect to said housing, a coupling arrangement between said housing and said turret support ring, whereby said housing is prevented from rotating about said turret axis with respect to said moonpool while enabling tilting of said turret axis with respect to said ring axis, wherein, said turret support ring includes an inward facing reaction surface, said housing includes an outward facing surface with said coupling arrangement arranged and designed for contact between said inward facing surface and said outward facing surface when said turret axis tilts with respect to said ring axis, and wherein, said inward facing reaction surface of said turret support ring is a cylindrical surface which is parallel to said ring axis, and said outward facing cylindrical surface of said outer housing is curved and designed for contact with said reaction surface when said turret tilts with respect to said moonpool.

3. A radial bearing arrangement for rotatably supporting a turret within a moonpool of a vessel, said turret having a generally vertical turret axis, the arrangement comprising, a turret support ring secured to said moonpool, said turret support ring having a ring axis, an outward facing ring surface disposed on said turret, a bearing assembly mounted on said turret including a housing having an inward facing cylindrical surface and a bushing retained between said outward facing ring surface of said turret and said inward facing cylindrical surface of said housing, by which said turret is free to rotate about said turret axis with respect to said housing, a coupling arrangement between said housing and said turret support ring, whereby said housing is prevented from rotating about said turret axis with respect to said moonpool while enabling tilting of said turret axis with respect to said ring axis, wherein said turret support ring includes a key and said housing of said bearing assembly has a slot which is positioned about said key, whereby said housing of said bearing assembly is substantially prevented from rotating about said ring axis.

4. A radial bearing arrangement for rotatably supporting a turret within a moonpool of a vessel, said turret having a generally vertical turret axis, the arrangement comprising, a turret support ring secured to said moonpool, said turret support ring having a ring axis, an outward facing ring surface disposed on said turret, a bearing assembly mounted on said turret including a housing having an inward facing cylindrical surface and a bushing retained between said outward facing ring surface of said turret and said inward facing cylindrical surface of said housing, by which said turret is free to rotate about said turret axis with respect to said housing, a coupling arrangement between said housing and said turret support ring, whereby said housing is prevented from rotating about said turret axis with respect to said moonpool while enabling tilting of said turret axis with respect to said ring axis, wherein said turret includes top and bottom annular shoulders adjacent said outer facing ring surface of said turret, said outer housing has top and bottom surfaces, said bushing includes a plurality of curved segments, and said curved segments being retained in an annular cavity defined by said outward facing ring surface of said turret, by said inward facing cylindrical surface of said housing, and by said top and bottom shoulders of said turret and by at least one retainer plate which overlaps at least one of said top and bottom annular shoulders and at least one of said top and bottom surfaces of outer housing, and wherein, said inward facing cylindrical surface includes a slot, and wherein said bearing segments include at least one segment having a retainer key arranged and designed to fit within said slot.

5. A radial bearing arrangement for rotatably supporting a turret within a moonpool of a vessel, said turret having a generally vertical turret axis, the arrangement comprising, a turret support ring secured to said moonpool, said turret support ring having a ring axis, an outward facing ring surface disposed on said turret, a bearing assembly mounted on said turret including a housing having an inward facing cylindrical surface and a bushing retained between said outward facing ring surface of said turret and said inward facing cylindrical surface of said housing, by which said turret is free to rotate about said turret axis with respect to said housing, a coupling arrangement between said housing and said turret support ring, whereby said housing is prevented from rotating about said turret axis with respect to said moonpool while enabling tilting of said turret axis with respect to said ring axis, wherein, said turret support ring includes an inward facing reaction surface, said housing includes an outward facing surface with said coupling arrangement arranged and designed for contact between said inward facing surface and said outward facing surface when said turret axis tilts with respect to said ring axis and wherein, an annular space is provided between said inward facing reaction surface of said turret support ring and said outward facing surface of said housing, said annular space being arranged and designed to allow ovalization of said turret support ring caused by vessel structural deflections thereby preventing pinching of said turret support ring of said outer housing.

6. A radial bearing arrangement for providing rotatable radial support of a turret within a moonpool of a vessel, where said turret has a turret axis and is anchored by anchor legs to the seafloor, and where the moonpool has a moonpool axis, the arrangement comprising, a turret support ring secured to the moonpool and having a continuous cylindrical inward radial facing reaction surface, a radial bearing assembly mounted on said turret, said assembly having a housing by which said turret is free to rotate within said housing, said housing having a continuous, cylindrical outer rim, and a coupling including a gap between said continuous, cylindrical inward radial facing reaction surface of said turret support ring and said continuous, cylindrical outer rim of said housing by which said outer housing rotates about said turret axis when said vessel weathervanes about said moonpool axis and is capable of tilting with respect to said moonpool axis.

7. A radial bearing arrangement for providing rotatable radial support of a turret within a moonpool of a vessel, where said turret has a turret axis and is anchored by anchor legs to the seafloor, and where the moonpool has a moonpool axis, the arrangement comprising, a turret support ring secured to the moonpool and having an inward facing reaction surface, a radial bearing assembly mounted on said turret, said assembly having a housing by which said turret is free to rotate within said housing, said housing having an outer rim, and a coupling between said inward radial facing reaction surface of said turret and said outer rim of said housing by which said outer housing rotates about said turret axis when said vessel weathervanes about said moonpool axis, wherein, said coupling includes a key slot in said outer rim disposed about a key of said turret support ring, whereby rotational force of said vessel about said moonpool axis is transferred to said housing, and said moonpool and said outer housing are free to rotate together about said turret when said turret is anchored to the seafloor.

8. A radial bearing arrangement for providing rotatable radial support of a turret within a moonpool of a vessel, where said turret has a turret axis and is anchored by anchor legs to the seafloor, and where the moonpool has a moonpool axis, the arrangement comprising, a turret support ring secured to the moonpool and having an inward facing reaction surface, a radial bearing assembly mounted on said turret, said assembly having a housing by which said turret is free to rotate within said housing, said housing having an outer rim, and a coupling between said inward radial facing reaction surface of said turret and said outer rim of said housing by which said outer housing rotates about said turret axis when said vessel weathervanes about said moonpool axis, wherein, said coupling includes an outer curved profile arranged and designed for contact with said inward radial facing reaction surface, thereby allowing tilting of said turret axis with respect to said moonpool axis.

9. The arrangement of claim 8 wherein, said inward facing reaction surface and an outer surface of said outer curved profile of said housing are arranged for sliding and/or rolling contact.

10. A radial bearing arrangement for providing rotatable radial support of a turret within a moonpool of a vessel, where said turret has a turret axis and is anchored by anchor legs to the seafloor, and where the moonpool has a moonpool axis, the arrangement comprising, a turret support ring secured to the moonpool and having an inward facing reaction surface, a radial bearing assembly mounted on said turret, said assembly having a housing by which said turret is free to rotate within said housing, said housing having an outer rim, a coupling between said inward radial facing reaction surface of said turret and said outer rim of said housing by which said outer housing rotates about said turret axis when said vessel weathervanes about said moonpool axis, wherein, said outer rim of said housing includes an outwardly facing surface, and said coupling includes a gap between said outwardly facing surface of said outer rim and said inward radial facing surface of said turret support ring so that ovalization of said turret support ring due to environmental forces on said vessel does not pinch said outer rim of said housing.

11. A radial bearing arrangement for providing rotatable radial support of a turret within a moonpool of a vessel, where said turret has a turret axis and is anchored by anchor legs to the seafloor, and where the moonpool has a moonpool axis, the arrangement comprising, a turret support ring secured to the moonpool and having an inward facing reaction surface, a radial bearing assembly mounted on said turret, said assembly having a housing by which said turret is free to rotate within said housing, said housing having an outer rim, a coupling between said inward radial facing reaction surface of said turret and said outer rim of said housing by which said outer housing rotates about said turret axis when said vessel weathervanes about said moonpool axis, wherein, said coupling includes a key slot in said outer rim disposed about a key of said turret support ring, whereby rotational force of said vessel about said moonpool axis is transferred to said housing, and said moonpool and said outer housing are free to rotate together about said turret when said turret is anchored to the seafloor, said coupling includes an outer curved profile arranged and designed for contact with said inward radial facing reaction surface, thereby allowing tilting of said turret axis with respect to said moonpool axis, said outer rim of said housing includes an outwardly facing surface, and said coupling includes a gap between said outwardly facing surface of said outer rim and said inward radial facing surface of said turret support ring so that ovalization of said turret support ring due to environmental forces on said vessel does not pinch said outer rim of said housing.

12. The arrangement of claim 11 wherein, said radial bearing assembly includes bushing segments disposed between a turret ring disposed about the exterior of said turret and said housing, said housing having an opening for installation of bushing segments radially between said inward facing surface of said housing and said outward facing surface turret ring, and axially between top and bottom shoulders of said turret ring, a retainer key bushing segment arranged for closing said opening, at least one retainer plate arranged and designed to retain said bushing segments radially between said turret ring and said housing and between said top and bottom shoulders.

13. A radial bearing arrangement for providing rotatable radial support of a turret within a moonpool of a vessel, where said turret has a turret axis and is anchored by anchor legs to the seafloor, and where the moonpool has a moonpool axis, the arrangement comprising, a turret support ring secured to the moonpool and having an inward facing reaction surface, a radial bearing assembly mounted on said turret, said assembly having a housing by which said turret is free to rotate within said housing, said housing having an outer rim, a coupling between said inward radial facing reaction surface of said turret and said outer rim of said housing by which said outer housing rotates about said turret axis when said vessel weathervanes about said moonpool axis, wherein, said radial bearing assembly includes bushing segments disposed between a turret ring disposed about the exterior of said turret and said housing, and said housing has an opening for installation of bushing segments between said housing and said turret ring.

14. The arrangement of claim 13 further comprising, a retainer key bushing segment arranged for closing said opening, and top and bottom retainer places for capturing said bushing segments between said turret ring and said housing.

15. A method for installing a lower radial bearing assembly for a turret within a moonpool of a vessel, the method including the first steps of, providing a turret shaft segment having an outer ring surface, providing an outer bearing housing having an inner housing surface and an outer rim, capturing a bushing ring between said outer ring surface of said turret shaft segment and said inner housing surface, whereby said outer bearing housing is carried by said turret segment, attaching said turret shaft segment to said turret, attaching a reaction ring within said moonpool of said vessel, where said reaction ring has an inward facing reaction surface, followed by the steps of, installing said turret with said outer bearing housing mounted thereto into said moonpool and within said reaction ring, and coupling said outer rim of said outer bearing housing to said reaction ring with an outer facing surface of said rim facing said inward radial facing surface.

16. A method for installing a lower radial bearing assembly for a turret within a moonpool of a vessel, the method including the first steps of, providing a turret shaft segment having an outer ring surface, providing an outer bearing housing having an inner housing surface and an outer rim, capturing a bushing ring between said outer ring surface of said turret segment and said inner housing surface, whereby said outer bearing housing is carried by said turret shaft segment, attaching said turret shaft segment to said turret, attaching a reaction ring within said moonpool of said vessel, where said reaction ring has an inward facing reaction surface, followed by the steps of, installing said turret with said outer bearing housing mounted thereto into said moonpool and within said reaction ring, and coupling said outer rim of said outer bearing housing to said reaction ring with an outer facing surface of said rim facing said inward radial facing surface wherein, said coupling step includes the step of, installing a key of said reaction ring into a slot of said rim of said outer housing, and whereby said outer bearing housing of said lower radial bearing is rotationally coupled to said reaction ring.

17. A method for installing a lower radial bearing assembly for a turret within a moonpool of a vessel, the method including the first steps of, providing a turret shaft segment having an outer ring surface, providing an outer bearing housing having an inner housing surface and an outer rim, capturing a bushing ring between said outer ring surface of said turret segment and said inner housing surface, whereby said outer bearing housing is carried by said turret shaft segment, attaching said turret shaft segment to said turret, attaching a reaction ring within said moonpool of said vessel, where said reaction ring has an inward facing reaction surface, followed by the steps of, installing said turret with said outer bearing housing mounted thereto into said moonpool and within said reaction ring, and coupling said outer rim of said outer bearing housing to said reaction ring with an outer facing surface of said rim facing said inward radial facing surface, wherein, said coupling step includes the step of, installing said turret into said moonpool with a gap existing between said outer facing surface of said outer rim and said inward facing surface, said gap arranged and sized to allow for pivoting of the turret and ovalization of said reaction ring caused by vessel structural deflection, thereby prohibiting said reaction ring from pinching said outer housing and said turret.

18. A method for installing a lower radial bearing assembly for a turret within a moonpool of a vessel, the method including the first steps of, providing a turret shaft segment having an outer ring surface, providing an outer bearing housing having an inner housing surface and an outer rim, capturing a bushing ring between said outer ring surface of said turret segment and said inner housing surface, whereby said outer bearing housing is carried by said turret segment, attaching said turret shaft segment to said turret, attaching a reaction ring within said moonpool of said vessel, where said reaction ring has an inward facing reaction surface, followed by the steps of, installing said turret with said outer bearing housing mounted thereto into said moonpool and within said reaction ring, coupling said outer rim of said outer bearing housing to said reaction ring with an outer facing surface of said rim facing said inward radial facing surface, and providing a curved profile on said outer facing surface of said outer rim which is arranged and designed for contact with said inward radial facing reaction surface, thereby allowing tilting of said turret within said moonpool.

19. The method of claim 18 which includes the step of providing a surface on said curved profile of said outer rim whereby said outer housing can slide and/or roll with respect to said reaction ring during turret wobble.

* * * * *